US009125465B2

(12) United States Patent
Beckley

(10) Patent No.: US 9,125,465 B2
(45) Date of Patent: Sep. 8, 2015

(54) WALLET

(71) Applicant: Daniel Vern Beckley, Byron, MI (US)

(72) Inventor: Daniel Vern Beckley, Byron, MI (US)

( * ) Notice: Subject to any disclaimer, the term of this patent is extended or adjusted under 35 U.S.C. 154(b) by 0 days.

(21) Appl. No.: 14/014,308

(22) Filed: Aug. 29, 2013

(65) Prior Publication Data

US 2014/0060712 A1 Mar. 6, 2014

Related U.S. Application Data

(60) Provisional application No. 61/694,359, filed on Aug. 29, 2012.

(51) Int. Cl.
*A45C 1/06* (2006.01)
*A45C 11/18* (2006.01)
*A45C 13/18* (2006.01)

(52) U.S. Cl.
CPC ..... *A45C 1/06* (2013.01); *A45C 11/182* (2013.01); *A45C 13/185* (2013.01); *A45C 2001/065* (2013.01)

(58) Field of Classification Search
CPC .. A45C 1/06; A45C 11/182; A45C 2001/065; A45C 13/185
USPC ..... 206/37, 39, 38, 39.4; 150/119, 147, 150/131, 132, 140, 143, 133, 134, 145, 150/137; D3/247, 250, 252
See application file for complete search history.

(56) References Cited

U.S. PATENT DOCUMENTS

| | | | | |
|---|---|---|---|---|
| 6,121,544 | A * | 9/2000 | Petsinger | 174/353 |
| 7,287,666 | B2 * | 10/2007 | De Laforcade | 221/65 |
| 7,484,640 | B2 * | 2/2009 | von Falkenhausen et al. | 221/231 |
| 7,921,890 | B2 * | 4/2011 | Ho | 150/147 |
| 2003/0221848 | A1 * | 12/2003 | Wu | 174/35 R |
| 2005/0087454 | A1 * | 4/2005 | Chen | 206/39 |
| 2006/0076094 | A1 * | 4/2006 | Kaminski | 150/147 |
| 2009/0101255 | A1 * | 4/2009 | Long | 150/147 |
| 2009/0183913 | A1 * | 7/2009 | Chen | 174/377 |

FOREIGN PATENT DOCUMENTS

EP 1117066 A1 * 7/2001

* cited by examiner

*Primary Examiner* — Sue A Weaver
(74) *Attorney, Agent, or Firm* — Mitchell Law PLLC; Matthew W. Mitchell

(57) ABSTRACT

A wallet is disclosed for holding a plurality of articles such as credit cards, currency, identification cards, and licenses. A housing of the wallet is formed of a semi-rigid material having at least a container portion and a base portion. The container portion and the base portion are selectively slidably connectable to form a void space sized and configured to hold the plurality of articles. The housing includes an opening or a slot configured to slidably remove single articles from within the housing. A retention spring is preferably disposed within the housing and configured to secure a plurality of articles to an internal surface.

4 Claims, 9 Drawing Sheets

WALLET

CROSS REFERENCE TO RELATED APPLICATIONS

This application claims the benefit of U.S. Provisional Application No. 61/694,359 filed on Aug. 29, 2012 which is hereby incorporated herein by reference.

TECHNICAL FIELD

This disclosure relates in general to a wallet, and more particularly to a semi-rigid apparatus that securely contains items usually carried on one's person such as identification cards, credit cards, currency, etc.

BACKGROUND

The statements in this section merely provide background information related to the present disclosure and may not constitute prior art.

The use of wallets is well-known. Wallets are designed to carry articles such as credit cards, currency, business cards, pictures, keys, identification cards, licenses (such as a driver's license), plus assorted other paper items. The most common type of wallet has one or more compartments and is made to be carried in a pocket, specifically in one's back trouser's pocket. These wallets are, in general, made from fabric and/or leather goods and sewn to form storage pockets. They may also utilize a metal clip of sorts intended to hold paper currency. These storage pockets are typically sewn to hold one card or a few cards. Each pocket adds a layer of material, increasing the wallets overall thickness and limiting the amount of cards a wallet can carry. The result is that the wallet becomes bulky in size and if carried in one's trousers, the wallet can produce a significant, uncomfortable bulge.

Known wallets are additionally disadvantaged by stretching and become loose over time, leaving the cards and identification vulnerable to falling out and becoming lost, leaving the owner exposed to the possible threat of identity theft.

One known solution utilizes a clip to attempt to hold cards and currency without the use of fabric or leather. These money clips are sometimes used alone to hold currency or they are integrated into a container to hold the cash with the users cards. In either case the cards security is based on the spring tension of the clip. Theses clips, because of the spring tension, limit the maximum amount of cards a user can carry. Money clips are additionally problematic when used with a few items, as less tension is available to hold the items securely. Furthermore, personal credit cards and security cards are vulnerable to Radio Frequency Identification (RFID) theft in a conventional clip-based holder, wallet and purse.

In view of the above disadvantages and for other reasons, a need exists in the art for an improved wallet, or card and currency carrying device.

SUMMARY

A wallet is disclosed for holding a plurality of articles such as credit cards, currency, identification cards, and licenses. A housing of the wallet is formed of a semi-rigid material having at least a container portion and a base portion. The container portion and the base portion are selectively slidably connectable to form a void space sized and configured to hold the plurality of articles. The housing includes an opening or a slot configured to slidably remove single articles from within the housing. A retention spring is preferably disposed within the housing and configured to secure a plurality of articles to an internal surface.

Certain embodiments of the invention include a feature of radio frequency identification shielding.

Certain embodiments of the invention include an exterior clip configured to receive and hold currency.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
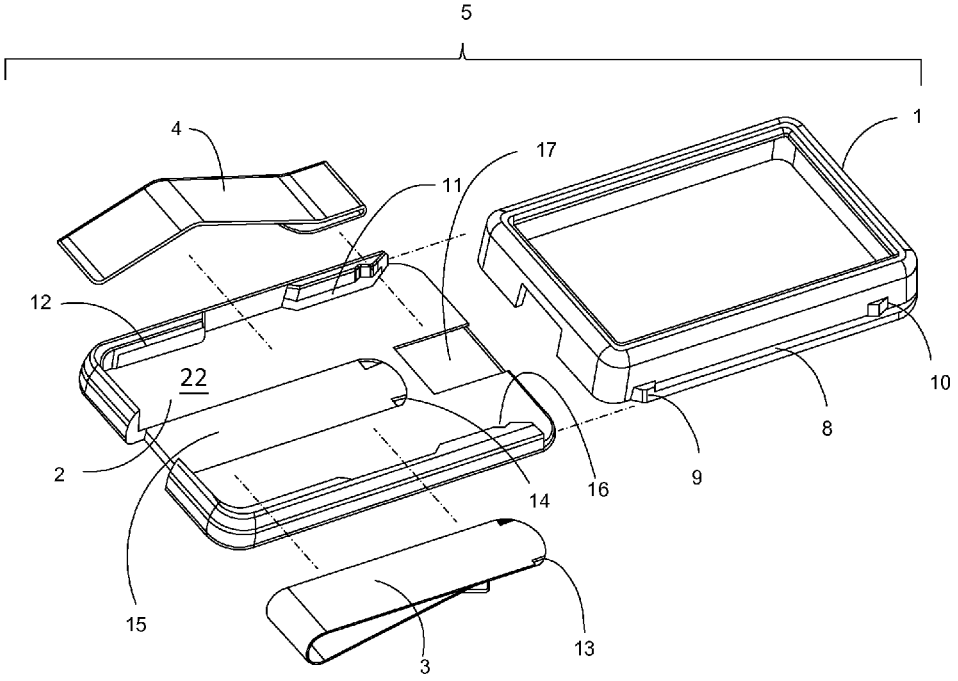
FIG. 1 is an exploded, perspective view of a wallet including a base portion, a container portion, a spring clip for holding currency and a retention spring for card retention, in accordance with the present disclosure.

Various embodiments of the present invention will be described in detail with reference to the drawings, where like reference numerals represent like parts and assemblies throughout the several views. The FIGS. illustrate an exemplary embodiment of a wallet and a method for assembling the same, wherein the depictions are for the purpose of illustrating certain exemplary embodiments only and not for the purpose of limiting the same. Reference to various embodiments does not limit the scope of the invention, which is limited only by the scope of the claims attached hereto. Additionally, any examples set forth in this specification are not intended to be limiting and merely set forth some of the many possible embodiments for the claimed invention. Based on the foregoing, it is to be generally understood that the nomenclature used herein is simply for convenience and the terms used to describe the invention should be given the broadest meaning by one of ordinary skill in the art.

Referring now to FIGS. 1-8, a wallet is shown generally at 5. The wallet 5 is formed of a plurality of components that may be formed of any number or materials including, e.g., molded plastic materials, thermoplastic or thermo-set elastomer, silicone-based materials, volcanized rubber blends, or fiber-based materials including carbon-based fibers and rigid para-aramid fibers. As used herein, the term "elastomer" is used to refer to any type of flexible or elastic material that has the ability to stretch to moderate elongations and return to a shape close to its original shape and may refer to thermoplastic or thermoset elastomers. In many embodiments, the elastomer may be formed as a melt at elevated temperature. In general, elastomers may be a class of copolymers, which may be a mix of a plastic and a rubber, which consist of materials with both a thermoplastic and elastomeric properties. Thermoplastic elastomers may be processed by injection molding, compression molding, or cast molding.

In an embodiment, the wallet 5 may be used for securing financial instruments, organizing and carrying currency, credit cards, identification cards (such as a driver's license) and any such item generally carried about one's person. It is contemplated that the size and shape of the containter may be adapted for use for particular articles. For example, in another embodiment, the wallet 5 may be sized and adapted for use as a container for business cards. A clip 3 in this embodiment is generally configured for holding paper currency, although it may function to hold a number of varying articles. In yet another embodiment, the clip 3 may be used to fasten the container to another object such as a pocket, personal organizer or book, for example.

FIG. 1 is an exploded, perspective view of a wallet 5. In one embodiment, the wallet 5 is constructed of four separate components including a container portion 1, a base portion 2, a spring clip 3 for holding currency and a retention spring 4 for card retention. Components of the wallet 5 are shown in FIG. 1 as separate elements. Such illustration is for ease of description and it should be recognized that some of the components of the wallet 5 may be integrally formed or formed as separate components, consistent with the teachings herein. For example, in the preferred embodiment, the container portion 1 and the base portion 2 are not integrally formed, rather the container portion 1 and the base portion 2 are selectively, slidably connectable as described herein below.

Figure 2A:
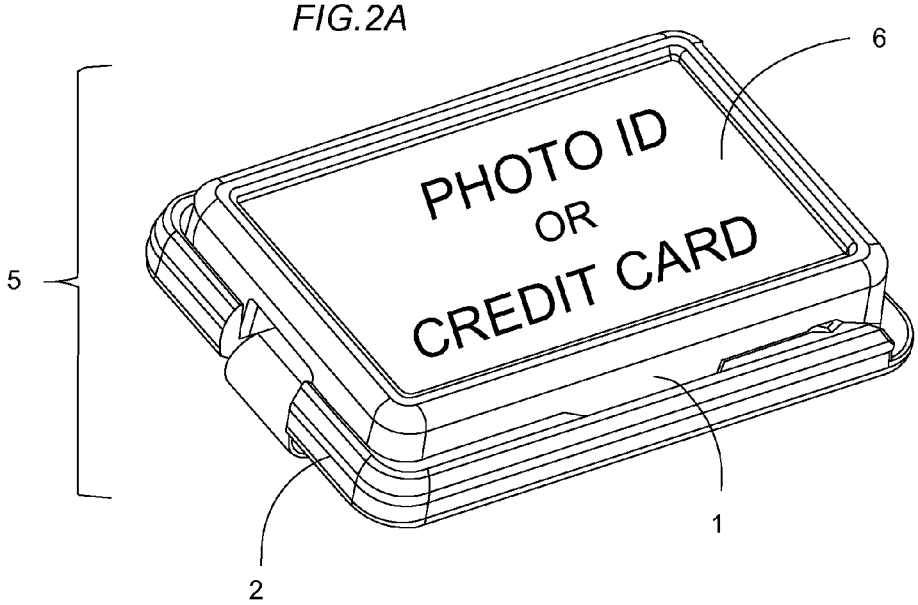
FIG. 2A is a top perspective view of a wallet showing the photo identification display window, in accordance with the present disclosure.
Figure 2B:
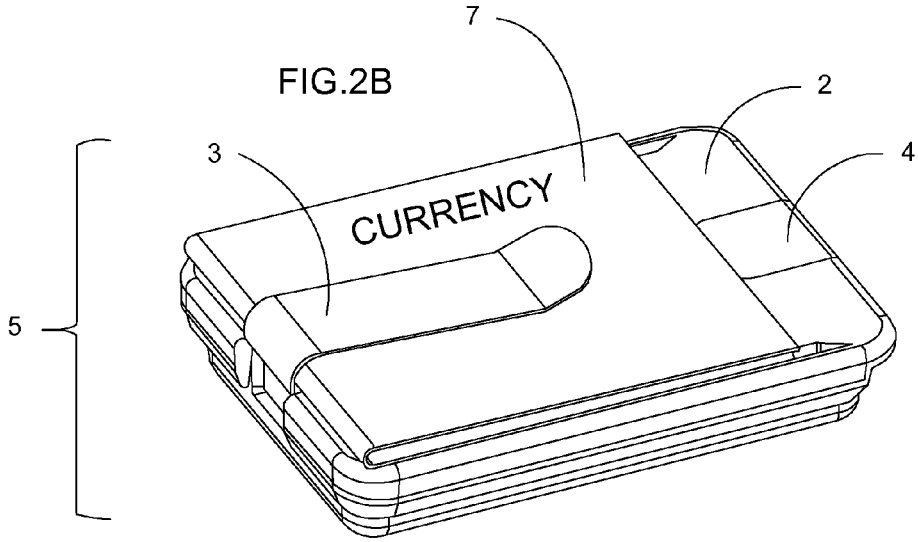
FIG. 2B is a bottom perspective view of a wallet showing the currency clip, in accordance with the present disclosure.

FIGS. 2A and 2B are top and bottom perspective views of the wallet 5. When connected, the container portion 1, the currency clip 3, and the retention spring 4 is assembled to the base portion 2, all comprising the wallet 5. As will be described in further detail herein below, a photo identification display window 6 is visible from the top perspective view of FIG. 2A. The currency clip 3 is accessible and viewable from the bottom perspective view of FIG. 2B.

Still referring to FIG. 1, the container portion 1 has a rail feature 8. As shown, the rail feature 8 is an elongated, horizontal protrusion extended along a side of the container portion 1. Preferably, a matching rail feature is formed on an opposite side running parallel to one another. The rail feature 8 is configured to slidably couple under a corresponding rail of the base portion 2. As shown in FIG. 1, when connecting the container portion 1 to the base portion 2, the matching rail feature of the container portion 1 would slide into a slot 11 under a corresponding rail feature 12 of the base portion 2. The rail feature 12 of the base portion 2 is positioned to form the slot 11 so that the rails of the container portion 1 fit firmly and slidably between the rail feature 12 and a housing surface 22. Similarly, the rail feature 8 would slidably guide the container portion 1 into the base portion 2 via the corresponding parallel slot and rail features of the base portion 2 not shown in FIG. 1. In one embodiment, the rail feature 8 includes a sliding surface 9 configured to slidably couple to the corresponding rail feature 12 of the base portion when so inserted.

The clip 3 is assembled to the base 2 by inserting the clip 3 into a depression 15. It is held in place by a pair of barbs seen at 13 mated into a set of cavities 14 on the base 2. The retention spring 4 is assembled to the base 2 by sliding it onto a pocket 17.

Referring back to FIGS. 2A and 2B, the wallet is shown having the components assembled. The container portion 1 is inserted into the base portion 2, the clip 3 is assembled to the base 2 by inserting the clip 3 into a depression 15 as described hereinabove. The retention spring 4 is slidably connected to the base portion 2 via the pocket 17. FIG. 2A shows a photo identification card or credit card, as seen at 6, visible when the card 6 is inserted into the wallet 5. FIG. 2B shows the reverse side of the wallet 5. A currency clip 3 can be seen holding paper currency, as seen at exemplary article 7, when the clip 3 is attached to the base 2.

Figure 3A:
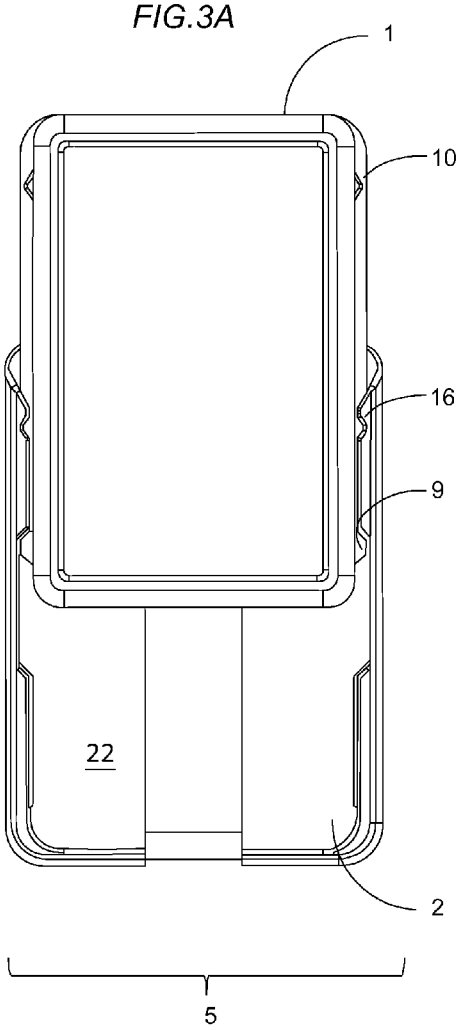
FIG. 3A is an orthogonal view of a wallet shown in an open position, in accordance with the present disclosure.

FIG. 3A shows the wallet 5 in an open position. The stop feature 9 is shown at its stop molded in base 2. The stop 9 prevents the container portion 1 from separating from base portion 2 when positioned within the base portion 2. In one embodiment, the stop 9 is a protrusion or edge profile configured to couple to a corresponding indentation or corresponding mating edge. Preferably, the wallet is formed of a semi-rigid material allowing the base 2 to flex when coupling the container 1 to the base 2. In this way, the stop 9 is coupled to a corresponding indentation or mating edge when inserting the container 1 into the base 2. One skilled in the art will recognize from a careful reading of the teachings herein that the stop 9, rail features and corresponding slots may be formed in one of many profiles including tongue and groove coupling profiles and lap-based profiles.

Figure 3B:
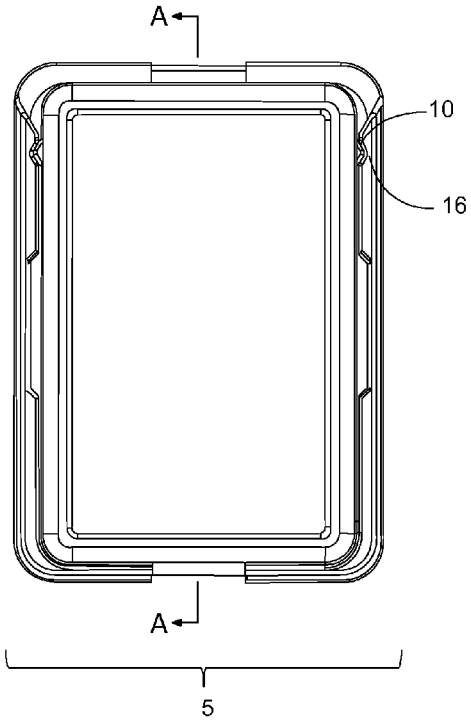
FIG. 3B is an orthogonal view of a wallet shown in a closed position, in accordance with the present disclosure.

FIG. 3B shows the wallet 5 in a closed position. A bump feature seen at 10 formed of the container 1, holds the wallet 5 closed when snapped into a detent feature seen at 16 and molded into the base 2. The bump 10 secures the contents of the wallet 5 when closed.

Figure 4A:
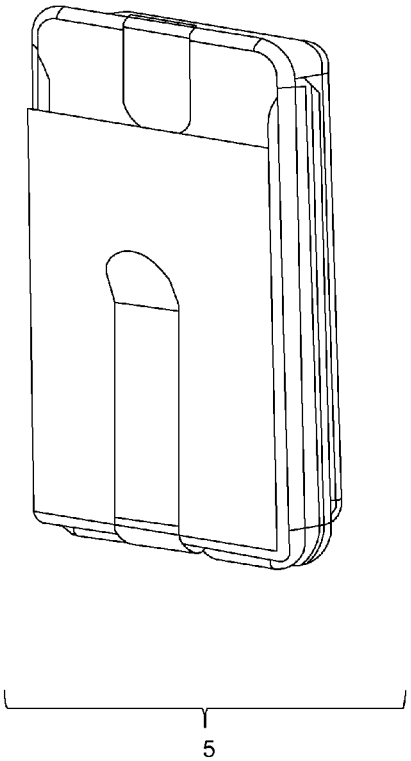
FIG. 4A is a perspective view of a wallet shown in a closed position, in accordance with the present disclosure.
Figure 4B:
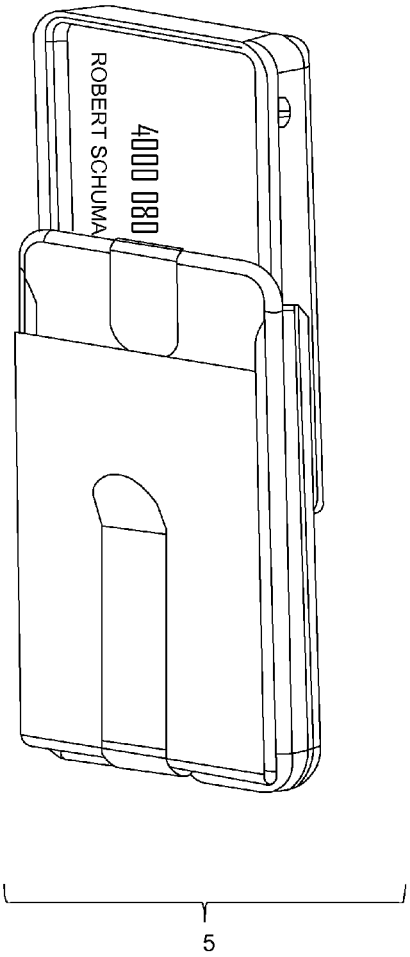
FIG. 4B is a perspective view of a wallet shown in open position, in accordance with the present disclosure.

FIGS. 4A and 4B show the wallet 5 in a perspective view. FIG. 4A shows the wallet 5 in an assembled, closed position keeping the contents secure. FIG. 4B shows the wallet 5 as seen in an open position giving access to the wallets contents while in use.

Figure 5A:
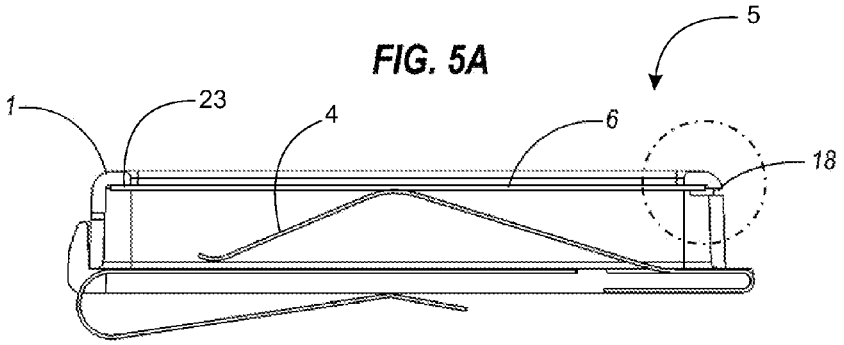
FIG. 5A is a cross-sectional view of a wallet along line A-A of FIG. 3B showing the ID card in a stowed position, in accordance with the present disclosure.
Figure 5B:
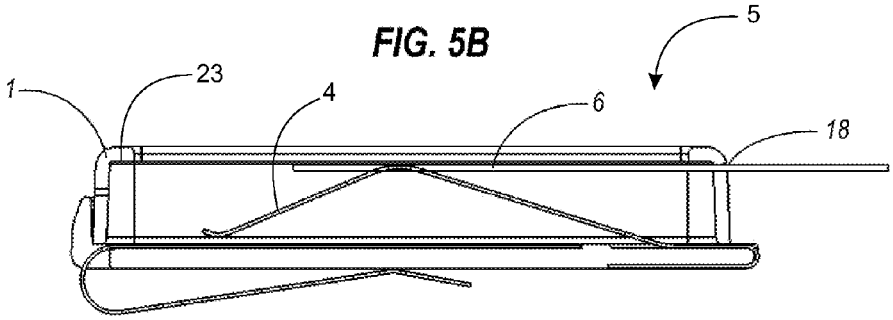
FIG. 5B is a cross-sectional view of a wallet along line A-A of FIG. 3B showing the ID card in a partially removed position, in accordance with the present disclosure.

FIGS. 5A-5D are cross-sectional views of the wallet 5 depicting various embodiments of the opening 18. FIG. 5A shows an exemplary identification card 6 in a stowed, secure position within the container portion 1. The card 6 is secured within the wallet 5 by the retention spring 4 using a spring force against a planar surface of the card 6 to a surface 23 of the container portion 1. The identification card 6 is shown as an exemplary card or article, one skilled in the art will recognize that the teachings herein will readily apply to many like-sized articles and cards such as a driver's license, credit card, and electronic key card. FIG. 5A also shows an opening at 18 formed of the container 1. The opening 18 is offset from the identification card 6 so as to not allow the identification card 6 to slide directly out. The identification card 6 needs to be pushed or directed downward by a user in order to align with the opening 18 to start removal of the identification card 6 from the container portion 1, as illustrated in FIG. 5B.

Figure 5C:
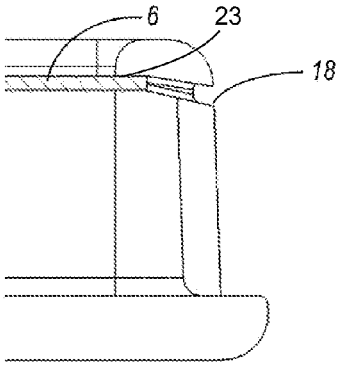
FIG. 5C is a cross-sectional view of a wallet along line A-A of FIG. 3B showing a detail view of the ID slot as an alternative embodiment in the area circled in FIG. 5A, in accordance with the present disclosure.
Figure 5D:
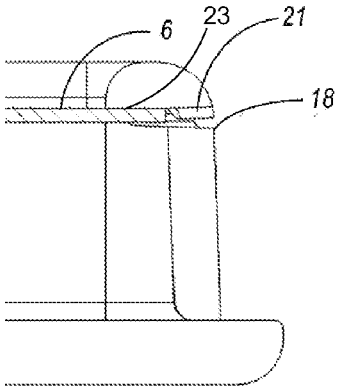
FIG. 5D is a cross-sectional view of a wallet along line A-A of FIG. 3B showing a detail view of the ID slot as another alternative embodiment in the area circled in FIG. 5A, in accordance with the present disclosure.

FIG. 5C shows a detailed alternative embodiment of the opening 18 formed at an angle. The angled opening holds the identification card 6 more securely and requires more pressure from the user than a non-angled opening to eject the identification card 6 from the container 1. FIG. 5D shows yet another alternative embodiment of the opening 18. The opening 18 is formed in line with the card 6. A raised area seen at 21 keeps the card secure until forward pressure is applied to the card forcing the raised area 21 upward.

Figure 6A:
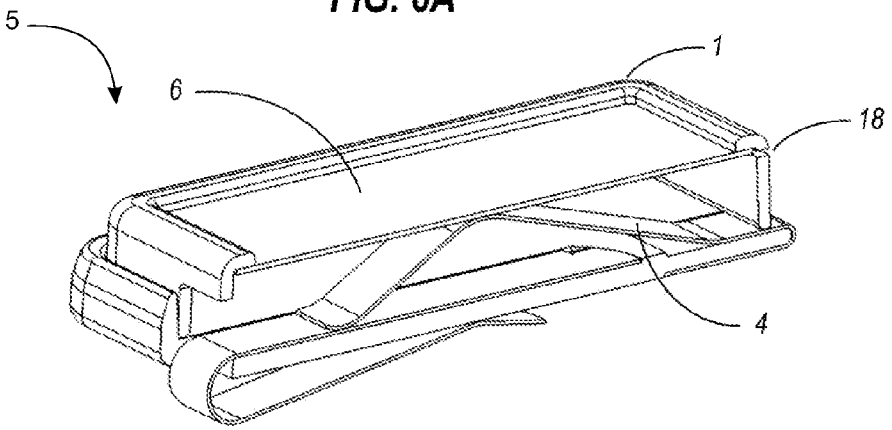
FIG. 6A is a perspective cross-sectional view of a wallet along line A-A of FIG. 3B showing the retention spring location with one card contained in the wallet, in accordance with the present disclosure.
Figure 6B:
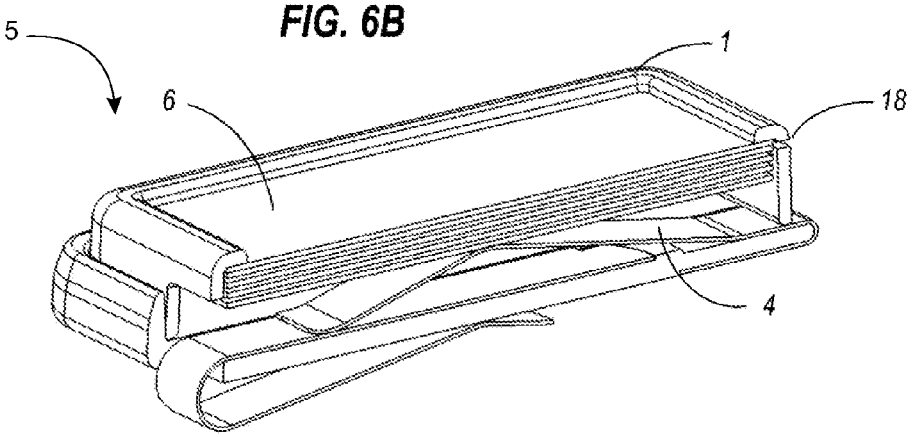
FIG. 6B is a perspective cross-sectional view of a wallet along line A-A of FIG. 3B showing the retention spring location when several cards are stored, in accordance with the present disclosure.

FIGS. 6A and 6B are perspective sectional views of the wallet 5 illustrating functions of the retention spring 4. FIG. 6A shows the position of the retention spring 4 when used with one card 6. The retention spring 4 exerts a spring force against a planar surface of the card 6 to a surface 23 of container portion 1, securing the card 6 and inhibiting movement of the card 6 inside the container portion 1. FIG. 6B shows the position of the retention spring 4 when used with a plurality of cards 6. The spring 4 is pushed down but will still hold the cards in a secure manner with the top card 6 flush with the opening inside container 1. Both exemplary card positions shown in FIGS. 6A and 6B keep the top card 6 from directly aligning with the opening 18 and holding the top card 6 securely inside. It should be noted that the retention spring 4 is not necessary for the present invention to operate and is an optional preferential embodiment.

Figure 7A:
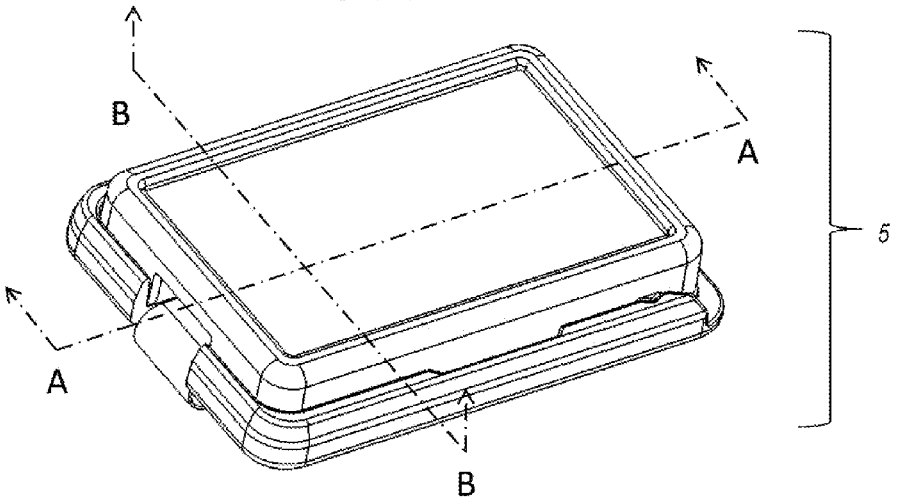
FIG. 7A is a perspective view of a wallet, in accordance with the present disclosure.
Figure 7B:
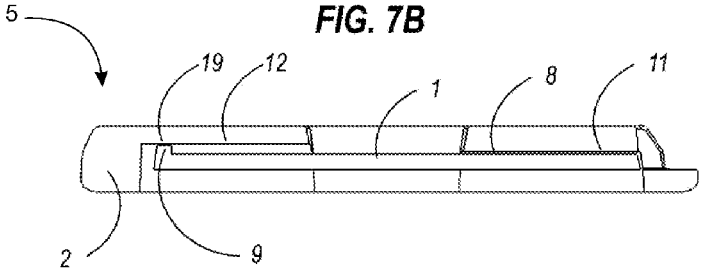
FIG. 7B is an orthogonal cross-sectional view, of a wallet along line, A-A of FIG. 7A, showing the container portion in a stowed position, in accordance with the present disclosure.
Figure 7C:
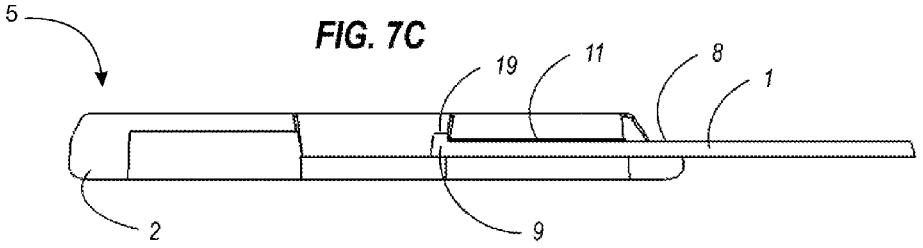
FIG. 7C is an orthogonal cross-sectional view of a wallet along line A-A of FIG. 7A, showing the container portion in its extended position, in accordance with the present disclosure.
Figure 7D:
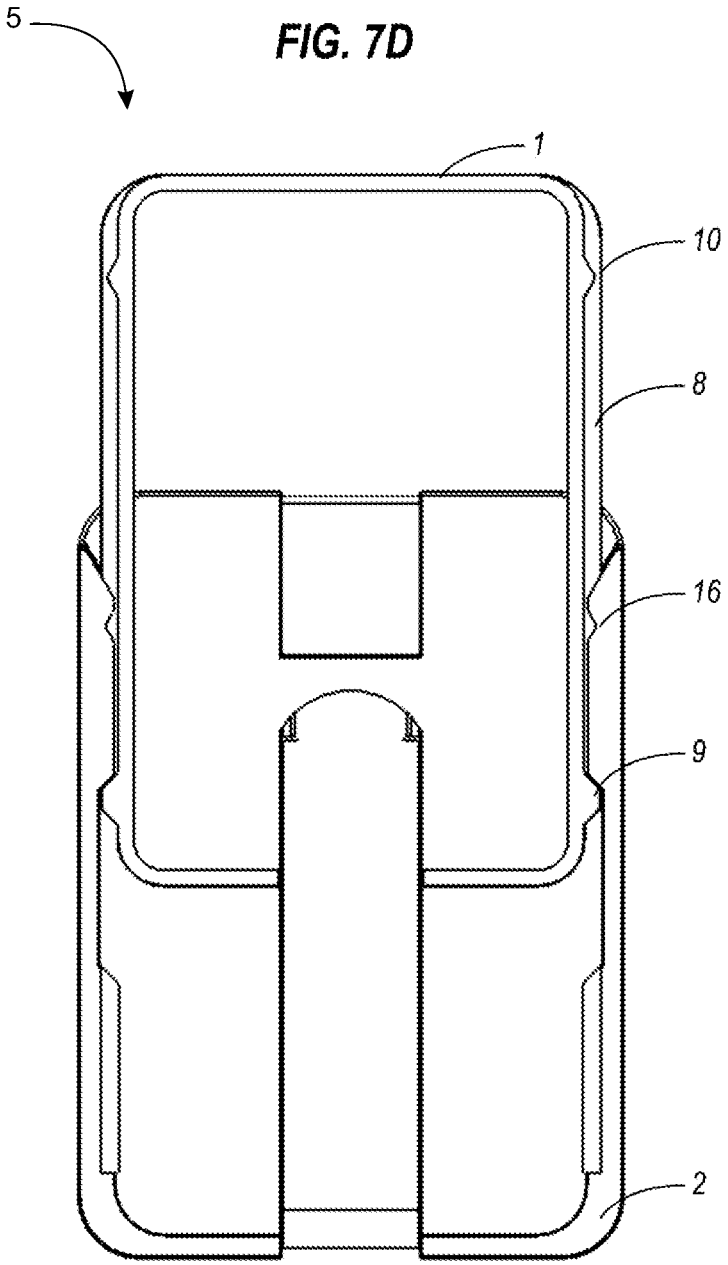
FIG. 7D is a top orthogonal cross-sectional view of a wallet along line B-B of FIG. 7A, in its extended position, in accordance with the present disclosure.

FIG. 7A is a perspective view of the wallet included to aid illustration of FIGS. 7B-7D. FIG. 7B shows a cross-sectional view of the container portion 1 in a closed position. A stop 9 works as a sliding surface as seen at 19 in the closed position against the rail feature 12. FIG. 7B also shows a rail 8 and interfacing with a slot 11. FIG. 7C shows the cross-sectional view of FIG. 7B depicting the container 1 in an open position. The stop 9 interferes with a wall at slot 11 to prevent the container portion 1 from sliding entirely out when sliding to an open position. FIG. 7D shows a cross-sectional view of the container 1 in an open position when assembled to the base 2. The container 1 is held from sliding any further out by the stop 9.

Figure 8A:
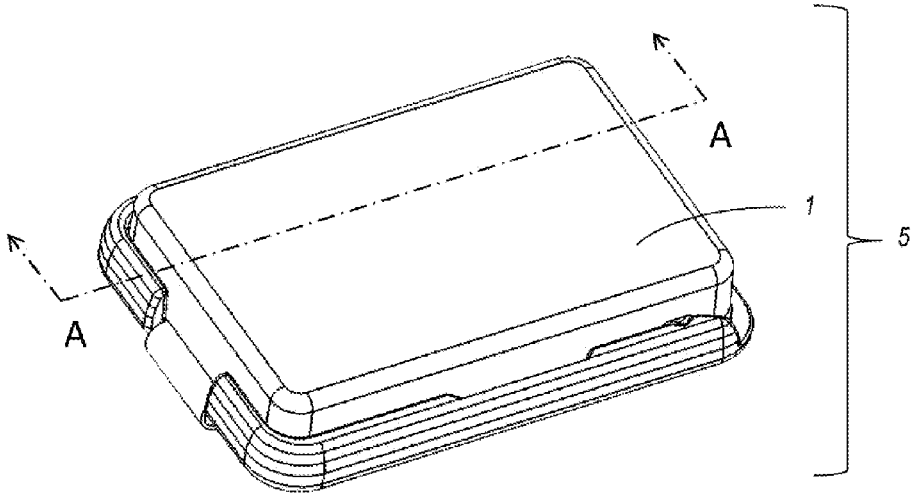
FIG. 8A is an isometric view of an alternate embodiment of a wallet, in accordance with the present disclosure.
Figure 8B:
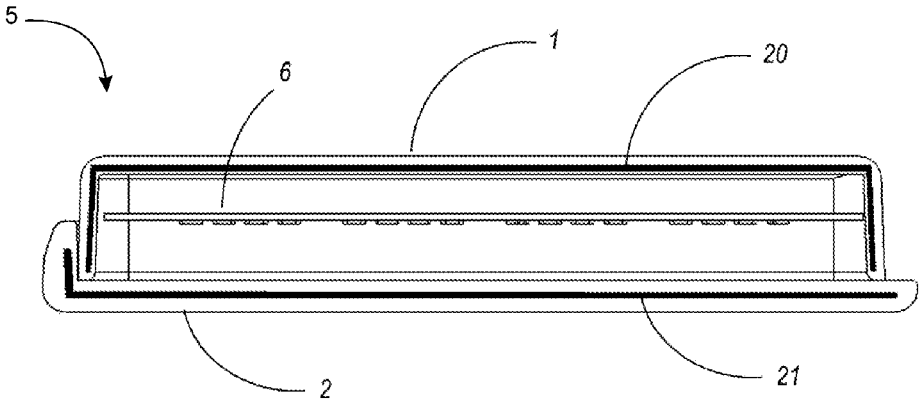
FIG. 8B is a sectional view of the alternate embodiment shown in FIG. 8A, in accordance with an exemplary embodiment of the invention.

FIGS. 8A and 8B are shown for illustrating an embodiment of the wallet 5 having RFID shielding material incorporated therein. As one skilled in the art will readily recognize, the RFID shielding material can be included using various techniques. The radio frequency shielding material can include a conductive material such as a metal or an electrically conductive plastic. The RFID shielding can be integral of the wallet material or attached using adhesive as a thin lining, in one embodiment. The radio frequency shielding material can include a mesh with a mesh size small enough to provide shielding against the radio frequency range used by RFID readers. In many embodiments the RFID shielding material is either flexible, transparent, or both. Examples of suitable RFID shielding materials include metal-coated elastomers such as aluminized Mylar and copper-coated plastic sheets and films. In some embodiments, the RFID shielding material is a semi-transparent mesh.

FIG. 8A shows a further alternate embodiment of the present invention. The container portion 1 is shown without a window for viewing an identification card or credit card. Omitting the window allows the RFID shielding material to be in molded or formed into housing of the carrier to block or absorb a radio signal used in radio frequency identification.

FIG. 8B is a cross-section of the alternative embodiment showing the RFID shielding material seen at 20 within the container 1 and at 21 within the base 2. Enveloping identification cards or credit cards 6 with a material that blocks radio frequencies 20, keeps information stored on the cards secure while in the closed wallet 5. Additionally, forming the container 1 and base 2 of materials that include materials that block or absorb radio frequencies will also protect the information stored on the cards 6.

In some embodiments, the RFID shielding material is effective to form a Faraday cage around the ID, object, or key. Closing the closure can be effective to complete the Faraday cage, in some instances. In other embodiments the RFID shielding is used in selective locations in the holder. The RFID shielding shields an RFID tag from a reader in two ways. First, the RFID shielding greatly reduces the power being broadcast from the reader that reaches the RFID tag within the holder. This cuts the power available to the RFID tag to transmit information back. Secondly, even if the RFID tag receives enough power to transmit, the signal sent from the RFID tag is also attenuated. Accordingly, it will be appreciated that the effectiveness of the RFID shielding can be varied considerably based on choices of radio frequency shielding materials and their thicknesses, mesh sizes, and so forth.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A wallet comprising:

a semi-rigid housing comprising a container portion and a base portion, wherein the container portion and the base portion are selectively slidably connected using integrated rails on sides of the container portion and sides of the base portion, wherein the rails slidably couple along surfaces of the rails when inserted, wherein the rails have a stop feature configured to partially open the wallet for internal access, and wherein the housing includes an opening adapted to remove an article from within the housing, and wherein the container portion includes a second opening sized and adapted to show a planar surface of an inserted article within the wallet; and a retention spring disposed within the housing and configured to secure a plurality of articles to an internal surface.

2. The wallet of claim 1, further comprising:

a clip disposed on the exterior surface of the housing, the clip configured to secure currency.

3. The wallet of claim 1, wherein the container portion and the base portion form a cavity when connected, the cavity sized and adapted to hold a plurality of articles.

4. The wallet of claim 1, further comprising: electromagnetic shielding configured to inhibit retrieval of information stored within the wallet.

* * * * *